US010799889B2

(12) United States Patent
Lin et al.

(10) Patent No.: US 10,799,889 B2
(45) Date of Patent: Oct. 13, 2020

(54) OUTLET DEVICE WITH MULTILEVEL ROTARY MASSAGE WATER

(71) Applicant: XIAMEN SOLEX HIGH-TECH INDUSTRIES CO., LTD., Xiamen, Fujian (CN)

(72) Inventors: Fengde Lin, Fujian (CN); Hailang Gong, Fujian (CN); Mingfu Zhang, Fujian (CN); Wenxing Chen, Fujian (CN)

(73) Assignee: XIAMEN SOLEX HIGH-TECH INDUSTRIES CO., LTD., Xiamen (CN)

( * ) Notice: Subject to any disclaimer, the term of this patent is extended or adjusted under 35 U.S.C. 154(b) by 120 days.

(21) Appl. No.: 15/938,663

(22) Filed: Mar. 28, 2018

(65) Prior Publication Data

US 2018/0318853 A1 Nov. 8, 2018

(30) Foreign Application Priority Data

May 8, 2017 (CN) ..... 2017 1 0317579

(51) Int. Cl.
*B05B 3/04* (2006.01)
*A61H 33/00* (2006.01)
(Continued)

(52) U.S. Cl.
CPC ..... *B05B 3/0422* (2013.01); *A61H 9/0028* (2013.01); *A61H 33/6036* (2013.01); *A61H 33/6057* (2013.01); *B05B 1/18* (2013.01); *B05B 12/002* (2013.01); *E03C 1/0405* (2013.01); *E03C 1/0409* (2013.01);
(Continued)

(58) Field of Classification Search
CPC ... B05B 3/0422; B05B 12/002; B05B 1/1654; B05B 1/18; B05B 1/16; E03C 1/0409; E03C 1/0405; A61H 33/6036; A61H 33/6057; A61H 9/0028; A61H 2201/5053; A61H 2201/5051
USPC ..... 239/443, 444, 446–449, 522–553.5, 239/556–568, 583, 390–392, 394; 251/237
See application file for complete search history.

(56) References Cited

U.S. PATENT DOCUMENTS 5,316,216 A * 5/1994 Cammack ..... B05B 1/1636 239/381
2011/0210189 A1* 9/2011 Chen ..... B05B 1/14 239/214

(Continued)

*Primary Examiner* — Qingzhang Zhou
*Assistant Examiner* — Joel Zhou
(74) *Attorney, Agent, or Firm* — Cooper Legal Group, LLC

(57) ABSTRACT

An outlet device with multilevel rotary massage water has a main body, an operating unit, a switching unit and a driver. The main body has a cavity for accommodating the driver and the cavity has inlets with at least two different directions; the water from the inlet flows into the cavity and rotates the driver; the driver rotates a massage driving outlet unit, and the direction of the flow of the massage driving outlet unit periodically changes with the rotation to form the massage water; the operating unit drives the switching unit to move so that at least two inlets are both open or one of the inlets is closed; then, the velocity of the flow in the cavity is changed, so that the rotational speed of the driver increases or decreases correspondingly and the switching frequency of the massage water also increases or decreases accordingly.

20 Claims, 8 Drawing Sheets

(51) Int. Cl.

| | |
|---|---|
| ***B05B 12/00*** | (2018.01) |
| ***E03C 1/04*** | (2006.01) |
| ***B05B 1/18*** | (2006.01) |
| ***A61H 9/00*** | (2006.01) |
| *B05B 1/16* | (2006.01) |

(52) U.S. Cl.
CPC ..... *A61H 2201/5051* (2013.01); *A61H 2201/5053* (2013.01); *B05B 1/1654* (2013.01)

(56) References Cited

U.S. PATENT DOCUMENTS

2012/0312403 A1* 12/2012 Zhou ..... B05B 1/1681
137/861
2014/0110502 A1* 4/2014 Yu ..... B05B 1/18
239/240

* cited by examiner

OUTLET DEVICE WITH MULTILEVEL ROTARY MASSAGE WATER

FIELD OF THE INVENTION

The present invention relates to an outlet device.

BACKGROUND OF THE INVENTION

At present, the shower having massage water on the market is shower having a plurality of holes, when used, the water interrupted from time to time by the impeller directly hits the body, causing discomfort. The consumer could only decreases the impact by adjusting the amount of the water coming from the shower. However, it only changes the direction of the water from the direction of the flow, and does not change the massage effect from the vertical flow plane. Therefore, the above functions of simplified shower can not meet the growing consumers' demand.

Thus, on the basis of not reducing the output of the shower, changing the effect of the existing shower and making the spray from the water outlet no longer directly hitting the human body with pressure, is the focus to be discussed by the industry. Now, some manufacturers have produced some showers having massage water. However, this kind of shower is often using the shower parts to massage, so the effect is not ideal and the pressure loss is also larger.

In addition, for different consumers, their desires for the switching frequency of water massage are not the same, if the switching frequency of water massage can not be adjusted, it can not find favour in all consumers' eyes.

SUMMARY OF THE INVENTION

The primary object of the present invention is to disclose an outlet device with function of massage water outflow and the adjustable switching frequency of the massage water, which is suitable for different users.

The other primary object of the present invention is to disclose an outlet device with multilevel rotary massage water, comprising: a main body, an operating unit, a switching unit and a driver;

The main body has a cavity for accommodating the driver, and the cavity has inlets with at least two different directions; the water from the inlet flows into the cavity and drives the driver to rotate; the driver drives a massage driving outlet unit to rotate, and the massage water is formed by the periodic changing of the flow's direction of the massage driving outlet unit due to the rotation;

the operating unit drives the switching unit to move so that at least two inlets are both at the state of open or one of the inlets is at the state of closed; then, the velocity of the flow in the cavity is changed making the rotational speed of the driver increase or decrease correspondingly and the switching frequency of the massage water also increase or decrease accordingly.

In the preferred embodiment: when at least the two inlets are both at the state of open, the velocity of the driver decreases and the switching velocity of the massage water decreases correspondingly; when one of them is at the state of closed, the velocity of the driver increases and the switching velocity of the massage water increases correspondingly.

In the preferred embodiment: the inlet has three kinds of inlet, which are a straight flowing hole, an oblique flowing hole and a slant flowing hole; the straight flowing hole is parallel to the longitudinal axis of the cavity, the oblique flowing hole has an acute angle with the longitudinal axis of the cavity, the slant flowing hole is perpendicular to the longitudinal axis of the cavity.

In the preferred embodiment: during the movement of the operating unit driving the switching unit to move, the switching unit has the first position, the second position and the third position; when the switching unit is at the first position, these three inlets are all at the state of open; when the switching unit is at the second position, the straight flowing hole is closed; when the switching is at the third position, the straight flowing hole and the oblique flowing hole are both closed.

In the preferred embodiment: the straight flowing hole and the oblique flowing hole are arranged on the top surface of the cavity, the slant flowing hole is on the side of the cavity; the switching unit is arranged coaxially with the cavity at the same longitudinal axis, and is above the top surface of the cavity; the operating unit drives the switching unit to move down along the longitudinal axis.

In the preferred embodiment: the switching unit comprises an ejector pin and a block, the ejector pin is arranged along the longitudinal axis, the block is arranged in parallel to the top surface of the cavity; the end of the ejector pin toward the cavity protrudes from the block; so when the switching unit is at the second position, the ejector pin protrudes into the straight flowing hole to close the straight flowing hole remaining a certain gap between the block and the top surface of the cavity; when the switching unit is at the third position, the ejector pin continues protruding into the straight flowing hole along the axis making the block press against the top surface of the cavity to close the oblique flowing hole.

In the preferred embodiment: the driver and a transmission mechanism are coaxially and rotationally arranged, the transmission mechanism is in rotation connection with the massage water outlet unit; the driver drives the transmission mechanism to drive the massage water outlet unit to rotate.

In the preferred embodiment: the transmission mechanism comprises a first gear arranged coaxially with the driver, and a second gear arranged coaxially with the massage water outlet unit; the first gear and the second gear are jointed and driven by each other.

In the preferred embodiment: there are at least two outlet holes arranged at the outlet surface of the massage water outlet unit in the straight linear distribution.

In the preferred embodiment: a commutator is also included, the commutator is linked with the operating unit and the switching unit respectively and changes the movement of the operating unit from rotation to moving along the longitudinal axis.

In the preferred embodiment: the commutator includes the first rotational mobile diverter unit, the mobile rotational diverter unit, the second rotational mobile diverter unit; wherein the second rotational mobile diverter unit is linked to the switching unit along the longitudinal axis.

In the preferred embodiment: the first rotational mobile diverter unit includes a top block linked with the operating unit and a mobile unit, the side of the mobile unit toward the top block has an inclined plane pressed against the top block; when the top block moves following the operation unit, the pushing force between the top block and the inclined plane pushes the mobile unit to move toward the direction away from the top block.

In the preferred embodiment: the mobile unit also includes the plane section linked to the inclined plane; when the top block moves along the inclined plane to the plane section, at least two kinds of the inlet are both open or one of the inlets is closed.

In the preferred embodiment: the mobile rotational diverter unit includes a connecting rod, the connecting rod is linked rotationally with a spindle, and one end of the connecting rod is pressing against the mobile unit, when the mobile unit moves away from the top block, the pushing force between the mobile unit and the connecting rod drives the connecting rod to rotate around the spindle.

In the preferred embodiment: the second rotational mobile diverter unit includes a valve shaft linked coaxially with the connecting rod and a valve body arranged coaxially with the valve shaft; the valve shaft and the valve body both have a inclined gear working with each other at the opposite sides of the valve shaft and the valve body; when the connecting rod drives the valve shaft to rotates, the pushing force between the inclined gears drives the valve body and the switching unit to move downwards along the longitudinal axis of the cavity.

In the preferred embodiment: the first reset unit and the second reset unit are also included, the first reset unit is arranged against the switching unit along the longitudinal axis, when the switching unit moves downwards along the longitudinal axis, the first reset unit accumulates elastic reset force; the second reset unit is linked with the connecting rod along the direction of the rotation, when the connecting rod pressed by the mobile unit rotates, the second reset unit accumulates elastic reset force.

In the preferred embodiment: the main body has a handle, the operating unit is a knob sheathed outside the surface of the handle.

The advantages of the present invention over the known prior arts are:

The present invention discloses a water outlet device with multilevel rotary massage water, in order to achieve the effect of slow massage water, the water is arranged to dash the flow driving unit from different direction, so that part of the impact is offset, the flow speed of the flow driving unit decreases, and then the switching frequency of massage water slows down. And through the closure of one or more inlets with different directions, the direction of the flow dashing the driving unit become simplified, simplified water makes the flow speed increases greatly, it also increases the switching frequency of the massage water, so that the effect of fast speed and medium speed massage water are achieved. And the three modes of massage water can be chosen by users, so that different people can choose their own suitable massage water switching frequency.

PREFERRED EMBODIMENT OF THE INVENTION

With the following description of the drawings and specific embodiments, the invention shall be easier to understand.

Figure 1:
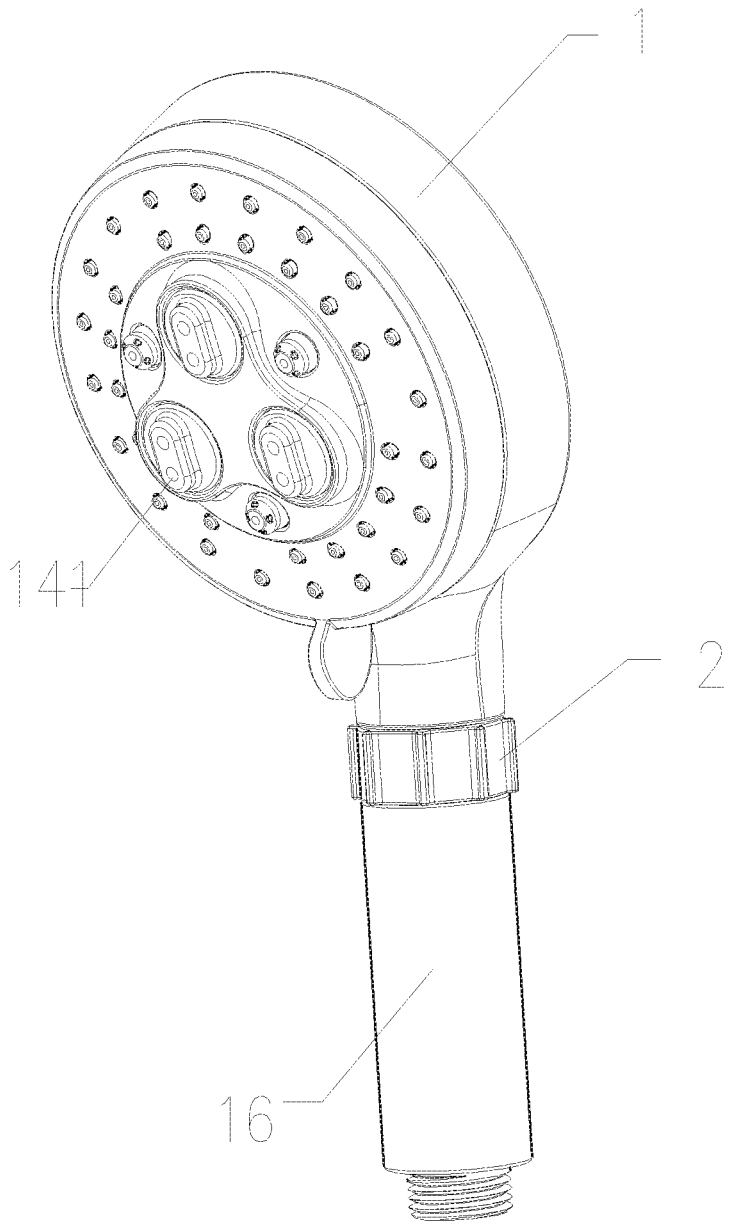
FIG. 1 is a perspective view showing a shower according to the preferred embodiment of the present invention.
Figure 2:
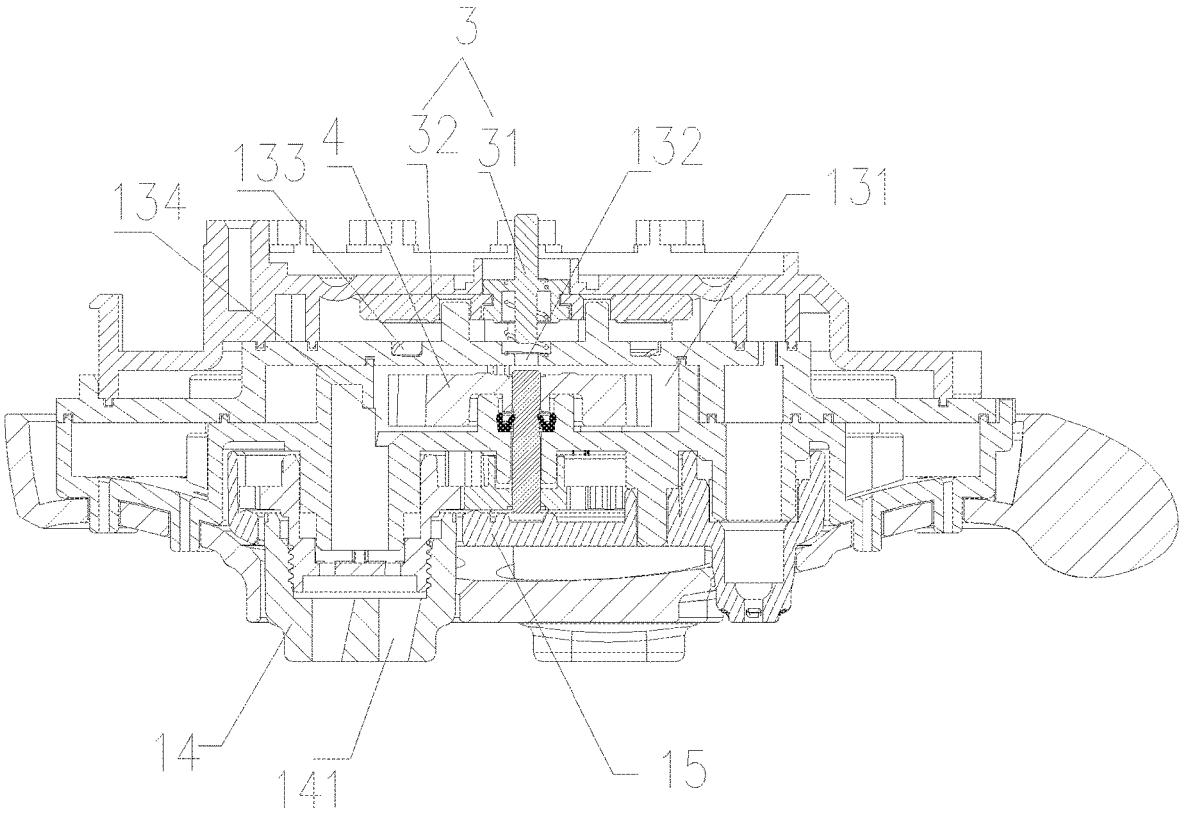
FIG. 2 is a sectional view showing a shower according to the preferred embodiment of the present invention.
Figure 3:
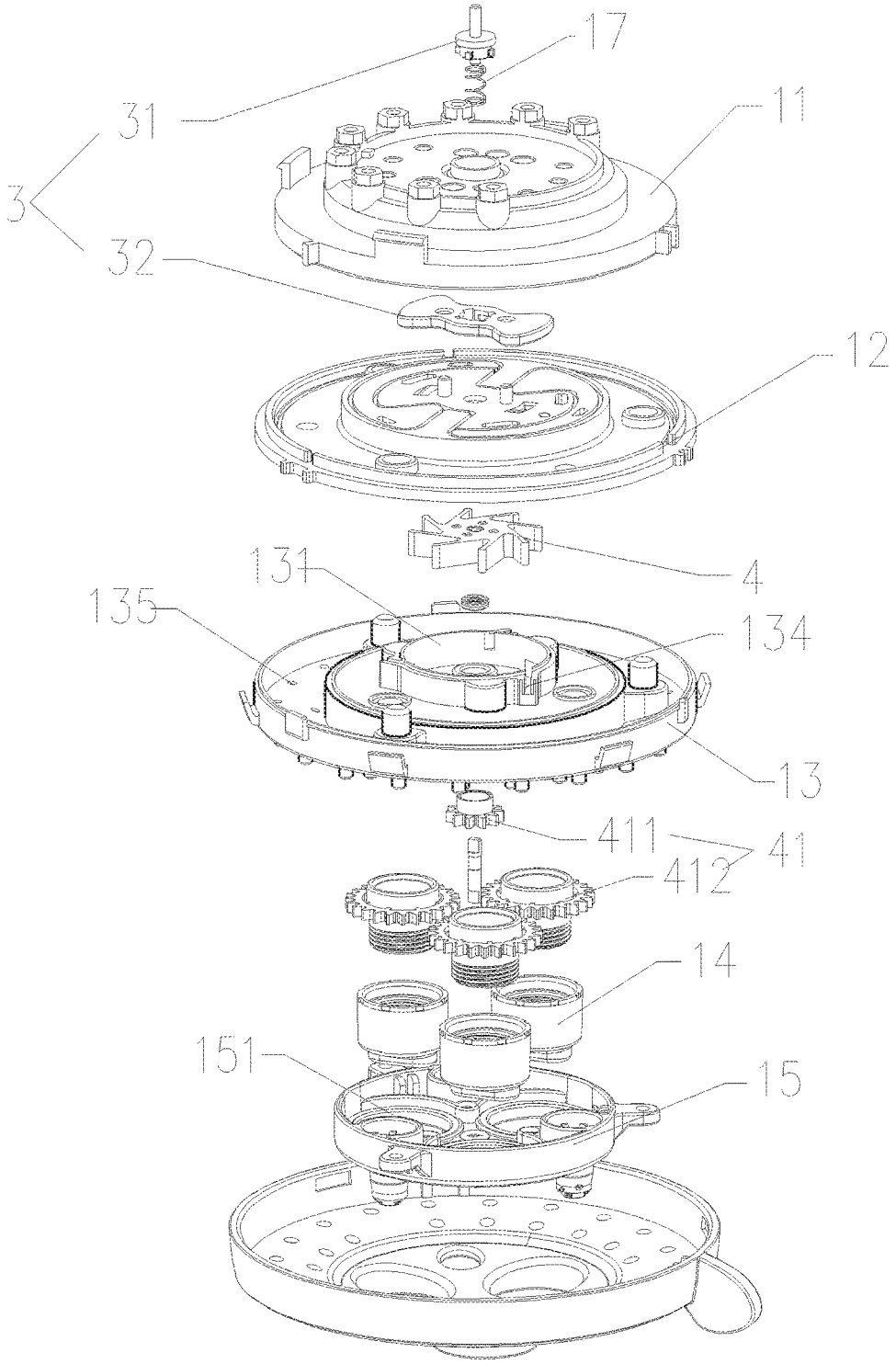
FIG. 3 is an exploded view showing a shower according to the preferred embodiment of the present invention.
Figure 4:
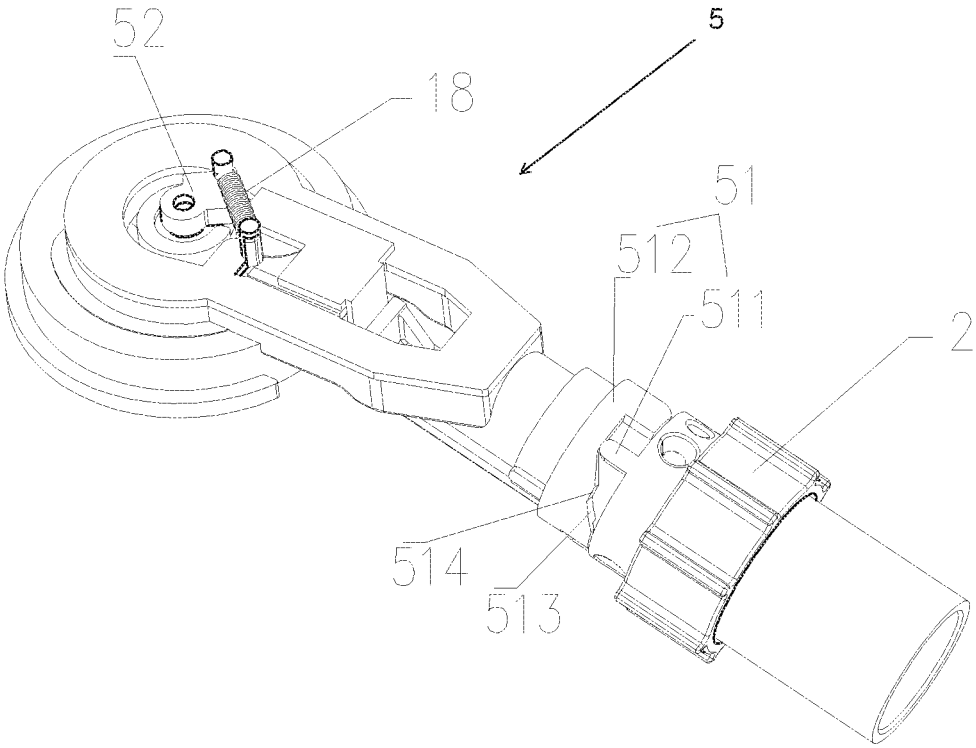
FIG. 4 is a structure diagrammatic sketch showing the first rotational mobile diverter unit according to the preferred embodiment of the present invention.
Figure 5:
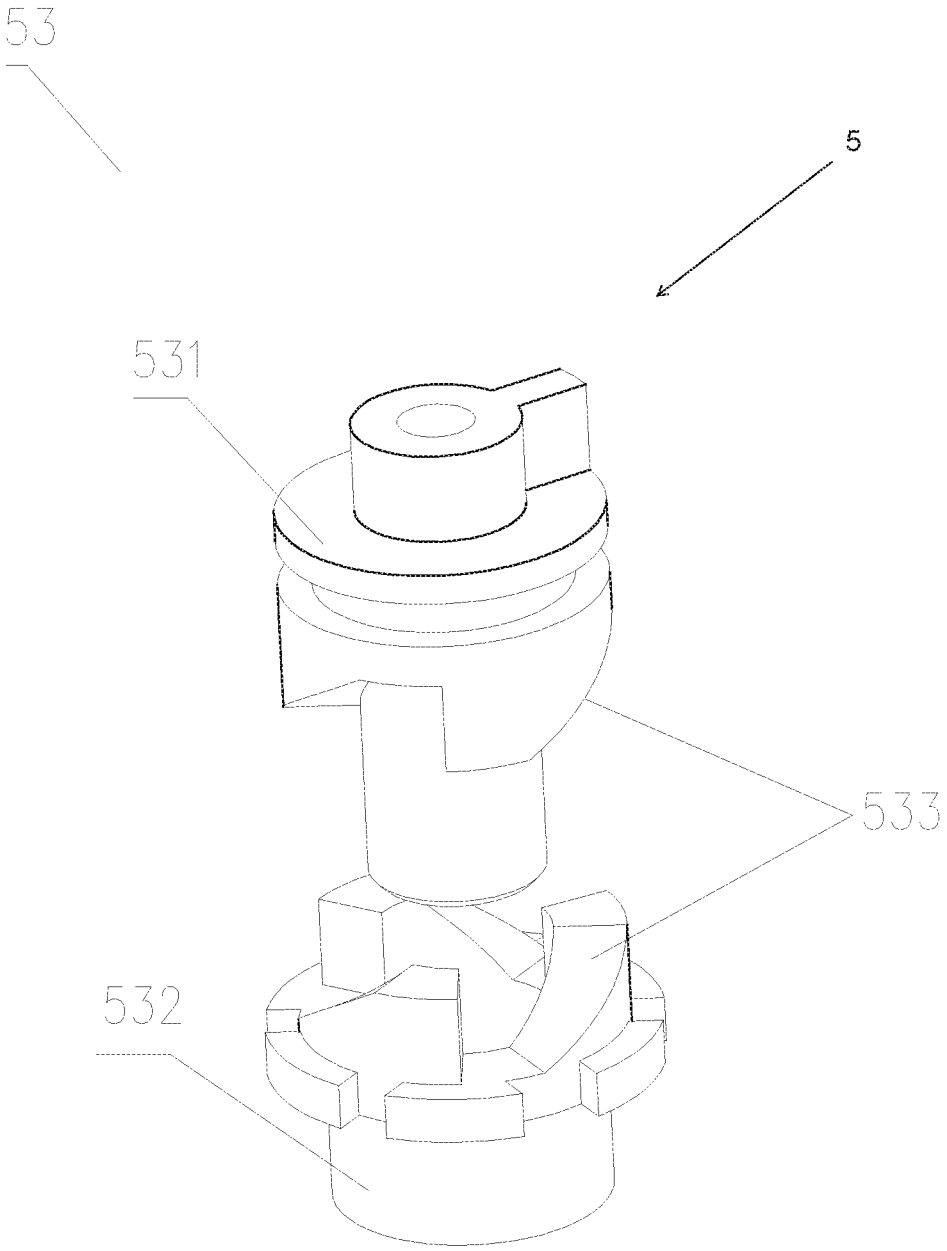
FIG. 5 is a is a structure diagrammatic sketch showing the second rotational mobile diverter unit according to the preferred embodiment of the present invention.
Figure 6:
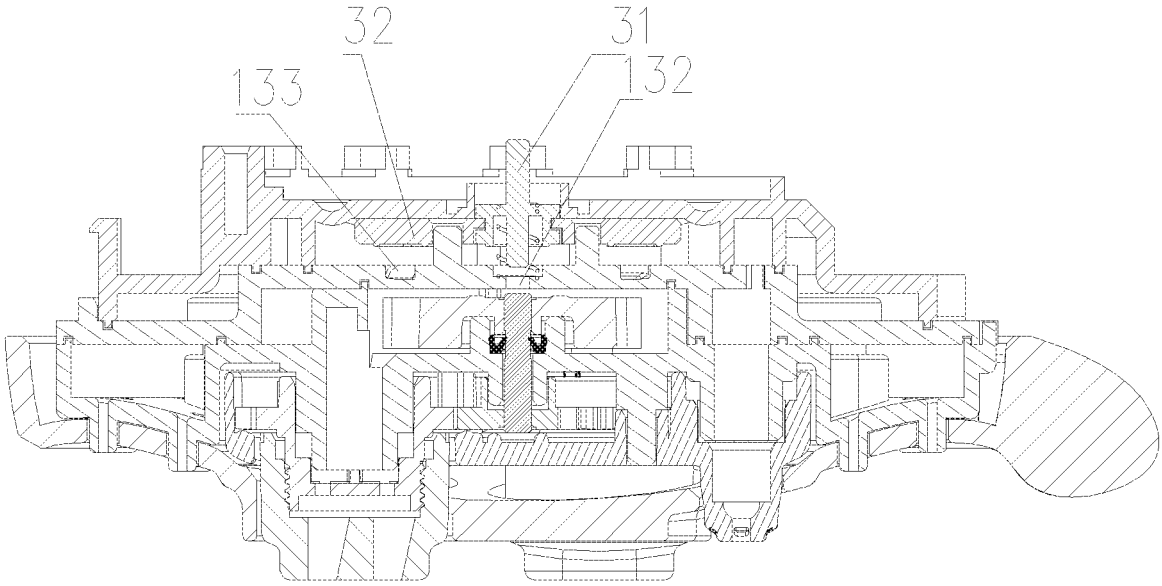
FIG. 6 is an abridged general view showing the switching unit at the first position according to the preferred embodiment of the present invention.
Figure 7:
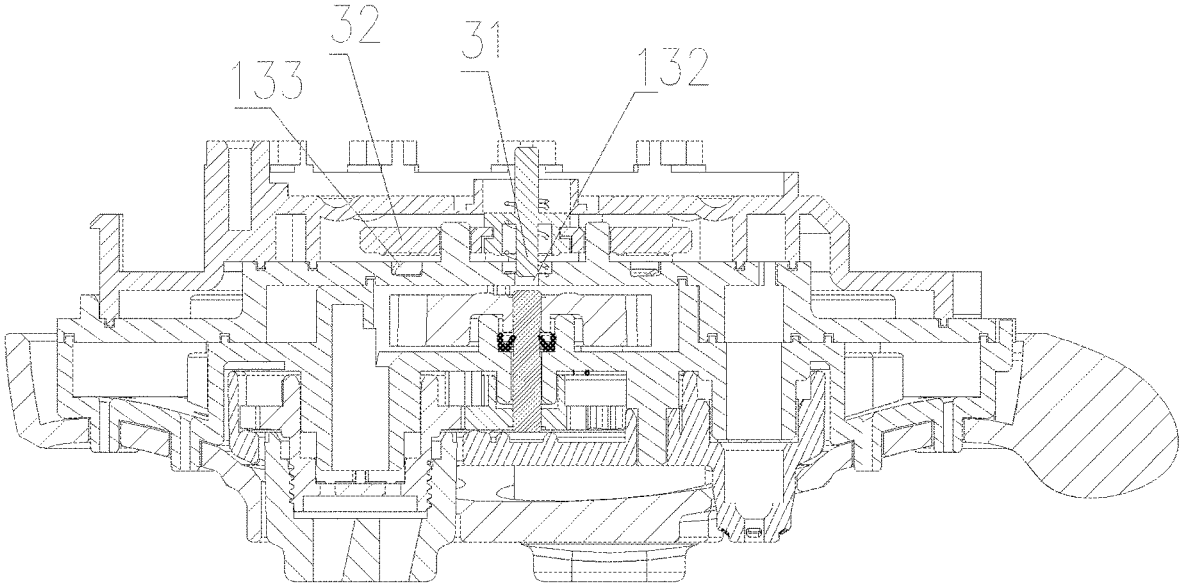
FIG. 7 is an abridged general view showing the switching unit at the second position according to the preferred embodiment of the present invention.
Figure 8:
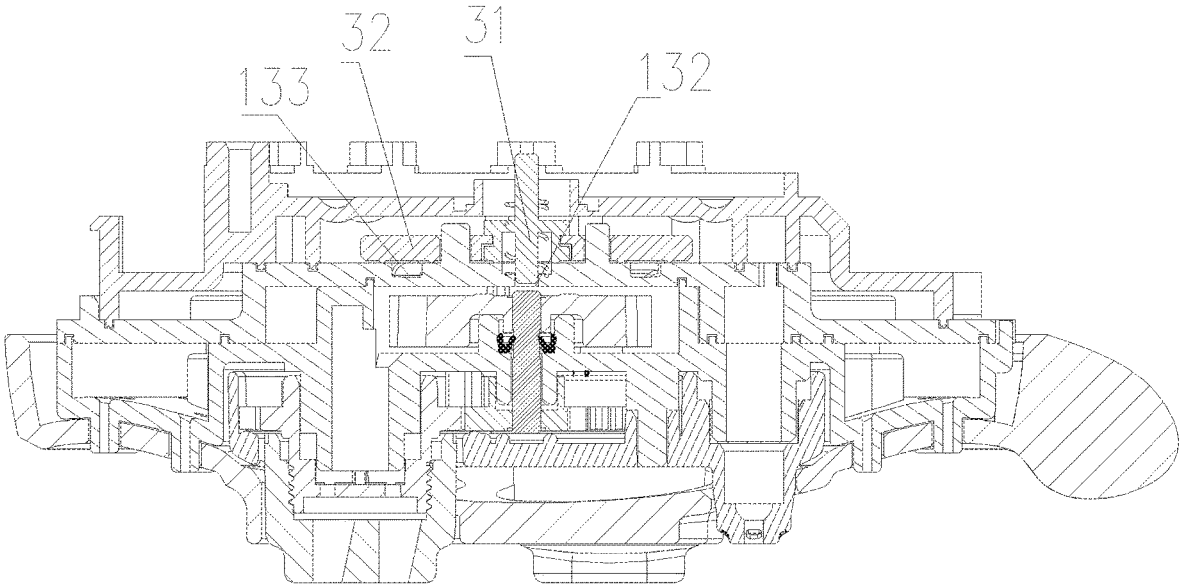
FIG. 8 is an abridged general view showing the switching unit at the third position according to the preferred embodiment of the present invention.

Referring to FIG. 1 to FIG. 8, a water outlet device with multilevel rotary massage water, in the embodiment, the outlet device is preferred but not limited to shower. The shower comprises: a main body 1, an operating unit 2, a switching unit 3 and a driver 4; wherein the main body 1 includes a water divided part 11, an inner plate 12, a big faceplate 13, a massage water outlet unit 14 and a massage water outlet cover 15. The inner plate 12 and the big faceplate 13 covering each other form the cavity 131 which accommodates the driver 4, the cavity 131 has at least two inlets with different directions; the water from the inlet into the cavity 131 drives the driver 4 to rotate; the driver 4 drives the massage driving outlet unit 14 rotate and the direction of the flow of the massage driving outlet unit 14 periodically changes with the rotation to form the massage water;

the operating unit 2 drives the switching unit 3 to move so that at least two inlets are both at the state of open or one of the inlets is at the state of closed; then, the velocity of the flow in the cavity 131 is changed, so that the rotational speed of the driver 4 increases or decreases correspondingly, and the switching frequency of the massage water also increases or decreases.

Therefore, the shower, in the preferred embodiment, could achieve changing the frequency of the massage water, and different users can select the frequency of the massage water that is suitable for their own frequency according to their requirements.

In the embodiment, there are three kinds of inlet, which are a straight flowing hole 132, an oblique flowing hole 133 and a slant flowing hole 134; the straight flowing hole 132 is parallel to the longitudinal axis of the cavity 131, the oblique flowing hole 133 has an angle with the longitudinal axis of the cavity 131, the slant flowing hole 134 is perpendicular to the longitudinal axis of the cavity 131.

Furthermore, the straight flowing hole 132 and the oblique flowing hole 133 are arranged on the top surface of the cavity 131, that is, arranged across the surface of the inner plate 12. The slant flowing hole 134 is on the side of the cavity 131; the switching unit 3 is arranged coaxially with the cavity 131 at the same longitudinal axis and is above the top surface of the cavity 131; the operating unit 2 drives the switching unit 3 to move down along the longitudinal axis.

During the movement of the operating unit 2 driving the switching unit 3 to move, the switching unit 3 has the first position, the second position and the third position; when the switching unit 3 is at the first position, three kinds of inlets are all at the state of open, the total area of the inlet is the largest, so the flow velocity in the cavity 131 is relatively slow, at the same time, because of the open state of the straight flowing hole, it applies a downward pressure along the longitudinal axis to the driver 4, so that the rotational friction force of the driver 4 increases; therefore, the rotation speed of the driver 4 is the slowest, and the switching frequency of the massage water is the slowest too; when the switching unit 3 is at the second position, the straight flowing hole 132 is closed, the total area of the inlet decreases and the driver 4 does not have a downward pressure along the longitudinal axis from the straight flowing hole 132. However, the driver 4 still has the downward pressure along the longitudinal axis from the oblique flowing hole 133. So now the velocity of the driver 4 increases to the medium state, and the massage water is also at a medium switching frequency; when the switching 3 is at the third position, the straight flowing hole 132 and the oblique flowing hole 133 are both closed, the total area of the inlet decreases further, the flow velocity in the cavity 131 becomes the fastest, and the downward pressure along the longitudinal axis of the oblique flowing hole 133 disappears, so at this point, the velocity of the driver 4 is the fastest, and the switching frequency of the massage water is the fastest too.

In order to realize the closing order of the straight flowing hole 132 and the oblique flowing hole 133 during the moving of the switch unit moving down along the longitudinal axis. The switching unit 3 comprises an ejector pin 31 and a block 32, the ejector pin 31 is arranged along the longitudinal axis, the block 32 is arranged in parallel to the top surface of the cavity 131, namely the inner plate 12; the end of the ejector pin 31 toward the cavity 131 protrudes from the block 32; so when the switching unit 3 is at the second position, the ejector pin 31 protrudes into the straight flowing hole 132 to close the flowing hole 132, a certain gap is between the block 32 and the cavity 131 to achieve the state of open of the oblique flowing hole 133 when the oblique flowing hole 133 is at the second position; when the switching unit 3 is at the third position, the ejector pin 31 continues protruding into the straight flowing hole 132 along the axis, the block 32 is pressing against the top surface of the cavity 131 to close the oblique flowing hole 133.

In order to let the driver 4 drive the massage water outlet unit 14 to rotate. In the embodiment, the driver 4 and a transmission mechanism 41 are coaxially and rotationally arranged, the transmission mechanism 41 is in rotation connection with the massage water outlet unit 14; namely the driver 4 drives the transmission mechanism 41 to drive the massage water outlet unit 14 to rotate.

The transmission mechanism 41 comprises a first gear 411 arranged coaxially with the driver 4, and a second gear 412 arranged coaxially with the massage water outlet unit 14; the first gear 411 and the second gear 213 are jointed and driven by each other. In the embodiment, the massage water outlet unit 14 divides into three groups, each group is separated from one another by 120 degrees, the second gear 412 corresponds to the massage water outlet unit 14 and also has three groups, the first gear 411 is located in the center of three groups of the second gears 412, and jointed with the three second gears 412.

In order to achieve that, when the massage water unit 14 rotates, the outlet angle changes, two outlet holes 141 are arranged at the outlet surface of the massage water outlet unit 14 in the straight linear distribution.

In the embodiment, the water divided part 11 and the inner plate 12 form two inlet cavities that are mutually independent, wherein the water of the first inlet cavity flows correspondingly into the straight flowing hole 132, the oblique flowing hole 133 and the slant flowing hole 134. The inner plate 12 also has an outlet corresponding to the second inlet cavity, the big faceplate 13 also has a shower water outlet 135 connecting to the outlet. Therefore, when the water flows into the second inlet cavity, the outlet mode of the shower is shower water, when the water flows into the first cavity, the mode of the shower is massage water. Also, in the massage water mode, users twisting the rotational operating unit 2 would not effect the outlet of the shower water at all and the misoperation is avoid effectively due to the reason that there is no water flowing into the first inlet cavity. In addition, setting a third inlet cavity could further increase the mode of water, such as the splashing water, it is a simple expanded scheme belonging to the scheme above.

In order to realize the switching of the mode of the shower, a switching button is arranged on the water outlet cover of the shower, which can make the water go to different inlet cavity by adjusting the button.

Also, a seat hole 151 is arranged in the massage water outlet cover 15, the massage water outlet unit 14 is exposed outside the massage water outlet cover 15 through the seat hole.

In the embodiment, the main body 1 has a handle 16, the operating unit 2 is a knob sheathed outside the surface of the handle 16. In order to enable the switching unit 3 to move down along the longitudinal axis when the operating unit 2 is turned, a commutator 5 is included. The commutator 5 is linked with the operating unit 2 and the switching unit 3 respectively and changes the operating unit 2 from rotation to moving along the longitudinal axis, so that the switching unit 3 is driven to move downwards along the longitudinal axis.

The commutator 5 includes the first rotational mobile diverter unit 51, the mobile rotational diverter unit 52, and the second rotational mobile diverter unit 53, which are sequentially arranged in a transmission way; wherein the second rotational mobile diverter unit 53 is linked to the switching unit 3 along the longitudinal axis.

The first rotational mobile diverter unit 51 includes a top block 511 linked with the operating unit 2 and a mobile unit 512, the side of the mobile unit 512 toward the top block 511 has an inclined plane 513 pressed against the top block 511; when the top block 511 moves following the operation unit 2, the pushing force between the top block 511 and the inclined plane 513 pushes the mobile unit 512 to move toward the direction away from the top block 511.

The mobile unit 512 also includes a plane section 514, in the embodiment, there are two inclined planes 513 and three plane sections 514, respectively arranged at the two ends of two inclined planes and between two inclined planes; when the top block 511 moves along the inclined plane 513 to one of the plane sections 514, the switching unit is correspondingly at one of these positions: the first position, the second position or the third position correspondingly.

The mobile rotational diverter unit 52 is a connecting rod, the connecting rod is linked rotationally with a spindle, and one end of the connecting rod is pressing against the mobile unit 512, when the mobile unit 512 moves along the direction away from the top block 511, the pushing force between the mobile unit 512 and the connecting rod drives the connecting rod to rotate around the spindle.

The second rotational mobile diverter unit 53 includes the valve spindle 531 linked coaxially with the connecting rod, and a valve body 532 arranged coaxially with the valve spindle 531; the valve body 532 is linked with the switching unit 3 along the longitudinal axis. The valve shaft 531 and the valve body 532 both have a inclined gear working with each other at the opposite sides of the valve shaft 531 and the valve body 532; when the connecting rod drives the valve shaft 531 to rotates, the pushing force between the inclined gears 533 drives the valve body 532 and the switching unit 3 to move downwards along the longitudinal axis of the cavity 131. The structure above is all the structure that achieves the switching unit 3 moving downwards along the central axis, in order to realize the cycle operation, the switching unit 3 needs to reset to the first position after moving to the third position, so, in the embodiment, a first reset unit 17 and a second reset unit 18 are included, they are spring and extension spring respectively. The first reset unit 17 is arranged against the switching unit 3 along the longitudinal axis, when the switching unit 3 moves downwards along the longitudinal axis, the first reset unit 17 accumulates elastic reset force; the second reset unit 18 is linked with the connecting rod along the direction of the rotation, when the connecting rod is pressed by the mobile unit 512 to rotate, the second reset unit 18 accumulates elastic reset force. So, when the operating unit 2 rotates back to its initial position, the first reset unit 17 pushes the switching unit 3 and the second mobile rotational diverter unit 52 move to reset along the longitudinal axis; the second reset unit 18 makes the second mobile rotational diverter unit 52 rotate reversely to reset, and then pushes the first rotational mobile diverter unit 51 to reset by moving reversely. The whole reset process is completed.

Although particular embodiments of the present invention have been described in detail for purposes of illustration, various modifications and enhancements may be made by the person skilled in the art without departing from the spirit and scope of the present invention are also in the scope of protection. Therefore, the scope of protection of the rights is based on the scope of the claims.

What is claimed is:

1. An outlet device with multilevel rotary massage water, comprising:

a main body, a switching unit, and a driver, wherein:

the main body comprises a cavity for accommodating the driver, the switching unit comprises at least one switching portion, the cavity comprises at least two inlet groups respectively extending along different directions, each of the at least two inlet groups respectively defines a different angle relative to a longitudinal axis of the cavity, the driver is driven to rotate by water flowing into the cavity from the at least two inlet groups, the driver drives a massage water outlet unit to rotate, massage water is formed by a periodic changing of a flowing direction of the massage water outlet unit while the massage water outlet unit rotates, and when the at least one switching portion switchably closes an inlet group of the at least two inlet groups with a smallest angle of the different angles:

a flow velocity of the water flowing into the cavity increases, and a rotational speed of the driver increases correspondingly.

2. The outlet device with multilevel rotary massage water according to claim 1, wherein:

the at least two inlet groups comprise three inlet groups, a first inlet group of the three inlet groups comprises at least one straight flowing hole, a second inlet group of the three inlet groups comprises at least one oblique flowing hole, a third inlet group of the three inlet groups comprises at least one side flowing hole, each of the at least one straight flowing hole is parallel to the longitudinal axis of the cavity, each of the at least one oblique flowing hole defines an angle other than 90° with the longitudinal axis of the cavity, and each of the at least one side flowing hole is perpendicular to the longitudinal axis of the cavity.

3. The outlet device with multilevel rotary massage water according to claim 2, wherein:

the switching unit is configured to move to a first position, a second position and a third position, and when the switching unit is disposed at the first position: all of the three inlet groups are open, when the switching unit is disposed at the second position:

the at least one straight flowing hole is closed, and when the switching unit is disposed at the third position: the at least one straight flowing hole and the at least one oblique flowing hole are closed.

4. The outlet device with multilevel rotary massage water according to claim 3, wherein:

the at least one straight flowing hole and the at least one oblique flowing hole are disposed on a top surface of the cavity, the at least one side flowing holes is disposed on a side surface of the cavity, the switching unit is disposed coaxially with the cavity in a direction of the longitudinal axis, the switching unit is disposed above the top surface of the cavity, and the switching unit is configured to move downward along the direction of the longitudinal axis.

5. The outlet device with multilevel rotary massage water according to claim 4, wherein:

the at least one switching portion comprises an ejector pin and a block, the ejector pin is disposed along the direction of the longitudinal axis and the block is disposed in parallel to the top surface of the cavity, a first end of the ejector pin facing toward the cavity protrudes from the block, when the switching unit is disposed at the second position:

the ejector pin is disposed in a corresponding one of the at least one straight flowing hole to close the corresponding one of the at least one straight flowing hole, and a gap remains between the block and the cavity, and when the switching unit is disposed at the third position:

the ejector pin is disposed further into the corresponding one of the at least one straight flowing hole along the direction of the longitudinal axis to make the block abut the top surface of the cavity to close the at least one oblique flowing hole.

6. The outlet device with multilevel rotary massage water according to claim 5, wherein:

the driver is rotatably disposed with a transmission mechanism, the transmission mechanism comprises a first gear coaxially disposed with the driver and a second gear coaxially disposed with the massage water outlet unit, the transmission mechanism is rotatably connected to the massage water outlet unit, and the driver drives the transmission mechanism to drive the massage water outlet unit to rotate.

7. The outlet device with multilevel rotary massage water according to claim 6, wherein the first gear mates with the second gear.

8. The outlet device with multilevel rotary massage water according to claim 6, wherein:

at least two outlet holes are disposed on an outlet surface of the massage water outlet unit, and the at least two outlet holes are respectively arranged in a straight line.

9. The outlet device with multilevel rotary massage water according to claim 1, comprising:

a commutator, and an operating unit, wherein:

the commutator is respectively connected to the operating unit and the switching unit and changes a movement of the operating unit from rotating to moving along a direction of the longitudinal axis, and the operating unit comprises a knob.

10. The outlet device with multilevel rotary massage water according to claim 9, wherein:

the commutator comprises a first rotation-movement diverter unit, a movement-rotation diverter unit, and a second rotation-movement diverter unit, and the second rotation-movement diverter unit is connected to the switching unit along the direction of the longitudinal axis.

11. The outlet device with multilevel rotary massage water according to claim 10, wherein:

the first rotation-movement diverter unit comprises a top block connected to the operating unit and a mobile unit, a side of the mobile unit facing toward the top block comprises an inclined plane abutting the top block, and when the top block moves to follow a rotation of the operating unit:

a first pushing force between the top block and the inclined plane pushes the mobile unit to move in a direction away from the top block.

12. The outlet device with multilevel rotary massage water according to claim 11, wherein:

the mobile unit comprises a plane section connected to the inclined plane, and when the top block moves along the inclined plane to the plane section:

all of the at least two inlet groups are open, or one of the at least two inlet groups is closed.

13. The outlet device with multilevel rotary massage water according to claim 12, wherein:

the movement-rotation diverter unit comprises a connecting rod, the connecting rod is rotatably connected to a spindle and a first end of the connecting rod abuts the mobile unit, and when the mobile unit moves away from the top block:

a second pushing force between the mobile unit and the connecting rod drives the connecting rod to rotate around the spindle.

14. The outlet device with multilevel rotary massage water according to claim 13, wherein:

the second rotation-movement diverter unit comprises a valve shaft coaxially connected with the connecting rod and a valve body coaxially connected with the valve shaft, the valve shaft and the valve body respectively have a first inclined gear and a second inclined gear, the first inclined gear and the second inclined gear are respectively disposed at opposite sides of the valve shaft and the valve body, and when the connecting rod drives the valve shaft to rotate:

a third pushing force between the first inclined gear and the second inclined gear drives the valve body and the switching unit to move downward along the direction of the longitudinal axis of the cavity.

15. The outlet device with multilevel rotary massage water according to claim 14, comprising:

a first reset unit, and a second reset unit, wherein:

the first reset unit comprise a first extension spring, the second reset unit comprises a second extension spring, the first reset unit abuts the switching unit along the direction of the longitudinal axis, when the switching unit moves downward along the direction of the longitudinal axis:

the first reset unit accumulates a first elastic reset force, and the second reset unit is connected to the connecting rod along a rotation direction of the connecting rod, and when the connecting rod is abutted by the mobile unit to rotate, the second reset unit accumulates a second elastic reset force.

16. The outlet device with multilevel rotary massage water according to claim 14, wherein:

the main body comprises a handle, and the knob surrounds an outer surface of the handle.

17. The outlet device with multilevel rotary massage water according to claim 1, wherein:

the at least two inlet groups are evenly disposed in the cavity, or the at least two inlet groups are radially symmetrically disposed in the cavity.

18. An outlet device with multilevel rotary massage water, comprising:

a main body, a switching unit, and a driver, wherein:

the main body comprises a cavity for accommodating the driver, the switching unit comprises at least one switching portion, the cavity comprises three inlet groups, the three inlet groups comprise at least one straight flowing hole, at least one oblique flowing hole, and at least one side flowing hole, each of the at least one straight flowing hole is parallel to a longitudinal axis of the cavity, each of the at least one oblique flowing hole defines an angle other than 90° with the longitudinal axis of the cavity, and each of the at least one side flowing hole is perpendicular to the longitudinal axis of the cavity, the driver is driven to rotate by water flowing into the cavity from the three inlet groups, the driver drives a massage water outlet unit to rotate, massage water is formed by a periodic changing of a flowing direction of the massage water outlet unit while the massage water outlet unit rotates, and when the at least one switching portion switchably closes the at least one straight flowing hole:

a flow velocity of the water flowing in the cavity increases, and a rotational speed of the driver increases correspondingly.

19. The outlet device with multilevel rotary massage water according to claim 18, wherein the at least one switching portion comprises an ejector pin and a block.

20. The outlet device with multilevel rotary massage water according to claim 1, wherein the at least one switching portion comprises an ejector pin and a block.

* * * * *